US006540020B1

(12) United States Patent
Falgout, Sr.

(10) Patent No.: US 6,540,020 B1
(45) Date of Patent: Apr. 1, 2003

(54) MOTOR BY-PASS VALVE

(75) Inventor: Thomas E. Falgout, Sr., Lafayette, LA (US)

(73) Assignee: Tomahawk Downhole, LLC, Lafayette, LA (US)

( * ) Notice: Subject to any disclaimer, the term of this patent is extended or adjusted under 35 U.S.C. 154(b) by 0 days.

(21) Appl. No.: 10/174,399

(22) Filed: Jun. 17, 2002

(51) Int. Cl.[7] ..... E21B 21/10; E21B 4/02

(52) U.S. Cl. ..... 166/250.01; 175/107; 175/40; 166/373

(58) Field of Search ..... 175/40, 38, 107, 175/101, 234, 317; 166/332.5, 250.01, 373, 67

(56) References Cited

U.S. PATENT DOCUMENTS 3,983,948 A * 10/1976 Jeter ..... 175/45
4,256,189 A * 3/1981 Fox et al. ..... 175/40
4,280,524 A * 7/1981 Beimgraben ..... 166/319
5,165,492 A 11/1992 Beasley
5,556,271 A * 9/1996 Zuercher et al. ..... 418/201.2
5,603,608 A * 2/1997 Marz ..... 417/13

* cited by examiner

*Primary Examiner*—Frank Tsay
(74) *Attorney, Agent, or Firm*—John D. Jeter

(57) ABSTRACT

A by-pass valve is part of an apparatus arranged to function as a serial element of a drill string. An arbor is attached to the top end of a tubular motor rotor and extends some distance along the generally central opening of the housing which is attached to the top end of the motor housing. A head on the arbor comprises a normally closed valve which is capable of conducting fluid from inside the housing to the well annulus outside the drill string by way of the bore of the tubular rotor. The valve is opened by downward movement, in excess of a selected amount, of the rotor of the motor. The excessive downward movement of the rotor indicates problems in the motor bearing structure, or disruptive failure elsewhere in the bottom hole assembly. The opening of the by-pass valve reduces standpipe pressure which is a signal detectable at the surface. The signal indicates disruptive failure in the down hole assembly.

18 Claims, 4 Drawing Sheets

MOTOR BY-PASS VALVE

This invention pertains to down hole motor controls. More specifically but not in a limiting sense, it pertains to apparatus that responds to change in the axial relationship of the motor rotor relative to the motor body to change the flow rate of fluid down the drill string relative to flow through the power producing portion of the motor.

BACKGROUND OF THE INVENTION

During the use of down hole motors, on pipe strings in wells, the rotor can move downward if the motor bearings wear excessively, or if selected motor assembly connections fail. In normal operation the pressure drop through the motor may not change enough, in response to motor trouble, to be detected at the surface. The pressure drop through the motor may be a small fraction of the overall pressure drop in the mud circuit of the overall system. The change in pressure drop through the motor may go undetected until extensive damage has occurred.

Rotor position sensors have been proposed that depend upon instrumentation and complex systems for indication of rotor position change that indicates damage. In the interest of simplicity and reliability, there is need for a failure detection system that depends only upon systems that are a normal part of the essential operation. Further, the detection method needs to be part of the parameters normally indicated and usually recorded.

SUMMARY OF THE INVENTION.

An arbor is attached to and preferably spins with the motor rotor, having a bore through the rotor shaft, that normally conducts a limited flow of fluid from the top of the rotor to an outlet downstream of the power producing portion of the motor. A valve in the arbor is normally closed and controls a fluid channel that opens into the drilling fluid supply channel upstream of the motor and opens into the motor rotor shaft bore.

A valve actuator is situated to engage a surface on the housing when the rotor moves axially a preselected amount and further movement opens the valve to allow fluid to flow through the bore of the rotor. The pressure drop across the motor is reduced when the rotor bore is added to the fluid flow path. The change in the overall pressure drop in the mud flow circuit is detectable at the surface. That pressure drop is an indication that the motor rotor has dropped more than a preselected amount.

An object of the invention is to provide a change in the pressure drop in the drilling fluid circuit when a down hole motor rotor changes axial position, a preselected amount, relative to the motor body.

Another object is to change pressure drop in the drilling fluid circuit in response to motor bearing failure without changing the motor design.

These and other objects, advantages, and features of this invention will be apparent to those skilled in the art from a consideration of this specification, including the attached claims and appended drawings.

BRIEF DESCRIPTIONS OF DRAWINGS

DETAILED DESCRIPTION OF DRAWINGS

In the formal drawings, features that are well established in the art and do not bear upon points of novelty are omitted in the interest of descriptive clarity. Such omitted features may include threaded junctures, weld lines, sealing elements, pins and brazed junctures. Various details of construction are designed to achieve the objectives of the invention by the most economical processes at hand. The details of construction are not intended to define metes and bounds of the claims.

Figure 1:
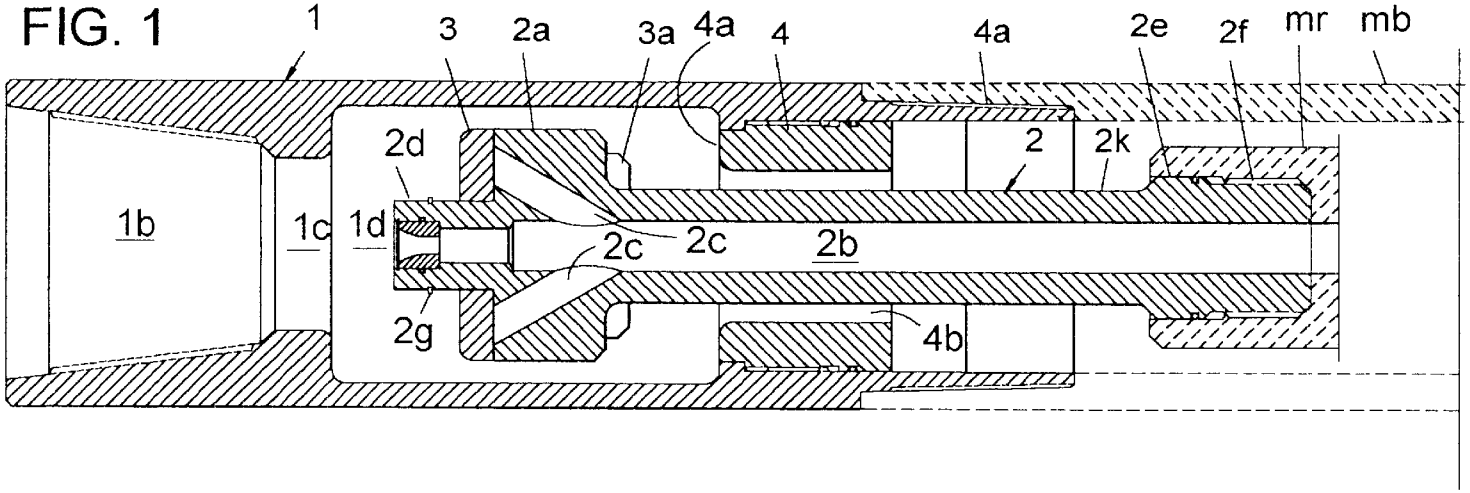
FIG. 1 is a side view, mostly cut away, of the preferred embodiment of the apparatus.
Figure 2:
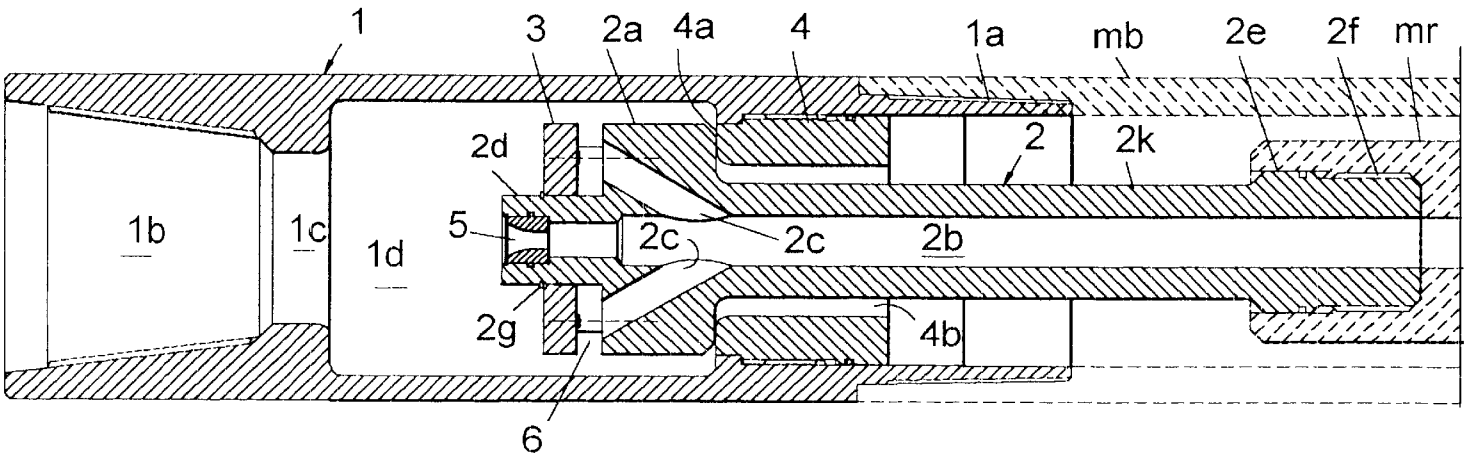
FIG. 2 is identical with FIG. 1, after actuation.

FIGS. 1 and 2 are sectioned along the general centerline of the apparatus which is attached to motor body mb and the associated motor rotor mr. Fluid, usually drilling mud, flows from the attached pipe string (not shown) through channels 1*c*, 1*d*, annular channel 4*b*, and through the motor along the annulus between the bore of motor body mb and the rotor mr. Part of the fluid, for several reasons, is usually metered through orifice 5, along channel 2*b* and into the motor rotor bore. The motor rotor bore by-passes at least most of the power producing portion of the motor (not shown) and is expelled either through the motor bearings or through the drill head (not shown) usually driven by the motor.

The rotor 2 rotates with the motor rotor. If it is a progressing cavity motor, the axis of the rotor orbits the motor body centerline. Channel 4*b* is large enough to allow the arbor mid-section 2*k* to run off center as necessary.

Housing 1, attached to the motor body by threads 1*a* extends along the motor body centerline. A by-pass valve is provided by a channel 2*c* which is normally closed by plate 3. Plate 3 has side actuator arms 3*a* (see FIG. 4) which extend down the slabbed off sides of arbor head 2*a*, arranged to engage the surface 4*a* of ring 4 if the rotor moves down a preselected amount.

Figure 5:
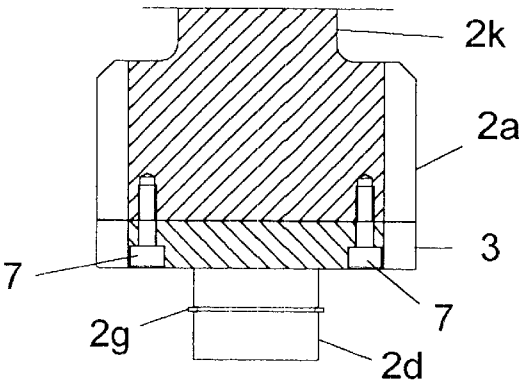
FIG. 5 is a side view of the portion shown in FIG. 3 taken along line 5—5.
Figure 3:
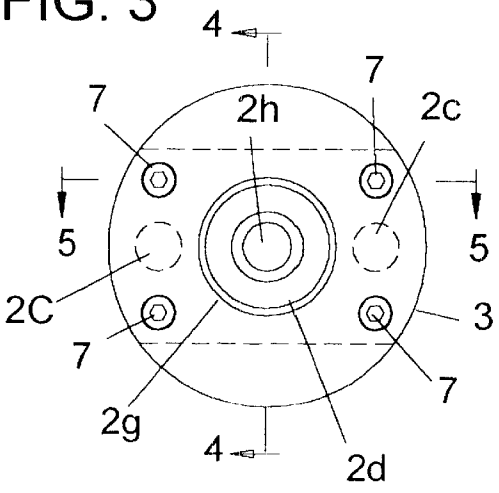
FIG. 3 is a top vies of the apparatus without the housing.

Cover plate 3 is held in the closed state by frangible screws 7, shown in FIGS. 3 and 5. When the rotor moves down a preselected amount and actuator arms 3*a* engage surface 4*a* the screws break and the cover plate 3, positioned by extension 2*d*, rises to the snap ring 2*g*. Fluid flows through the opening 6 between the actuator arms 3*a*, into channels 2*c* and down channel 2*b*. The flow through channel 2*b*, formerly restricted by orifice 5, increases to reduce the overall pressure drop through the motor. That pressure drop serves as a signal to the surface in the form of reduced stand pipe pressure. That pressure drop, as a signal, is anticipated by and is within the scope of the claims.

The motor rotor is commonly modified to accept threads 2*f* and accomplish fluid sealing on cylindrical surface 2*e*. O rings can assure sealing if necessary.

FIG. 3 is a view of the top of the arbor, downward as if from channel 1*c*. The openings of channels 2*c* are covered by cover plate 3. The plate 3 is held closed by cap screws, frangible screws, 7. The screws may be weakened by reducing the diameter between the screw head and the threads to limit strength as needed.

Figure 4:
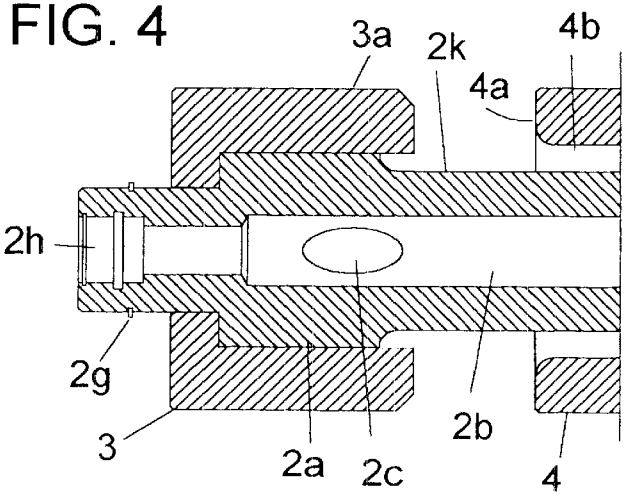
FIG. 4 is a side view, mostly cut away of a portion of the apparatus.

FIG. 4 is a side view sectioned along line 4—4. This shows the slabbed-off sides of arbor head 2*a* which accommodate the actuator U shape. The actuator arms 3*a* are well above surface 4*a* on ring 4 which is attached to the housing (see FIG. 1). Fluid flow into annular channel 4*b* is only slightly impeded.

FIG. 5 is sectioned to show the screws 7.

Figure 6:
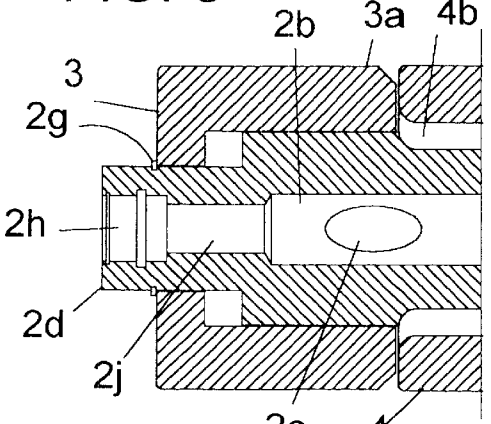
FIG. 6 is a side view identical to FIG. 4, after actuation.

FIG. 6 is identical to FIG. 4, but after actuation, which is caused by the movement of arbor 2 downward, or to the right. Flow into channel 4*b* is only slightly impeded because the actuator arm spacing leaves substantial openings. The flow to the openings of channels 2*c* is also between the actuator arms and the raised cover plate.

FIGS. 7 through 10 relate to an alternate configuration which replaces the frangible screws with springs which urge the cover plate to remain in position to seal channels 2*c*. The arbor head is changed to accept the spring arrangement and is now captioned 2*aa*. The cover plate is changed to accept the inverted screws 8 and it is now captioned 9. The actuator arms are unchanged but being part of the cover plate, they are captioned 9*a*.

Figure 7:
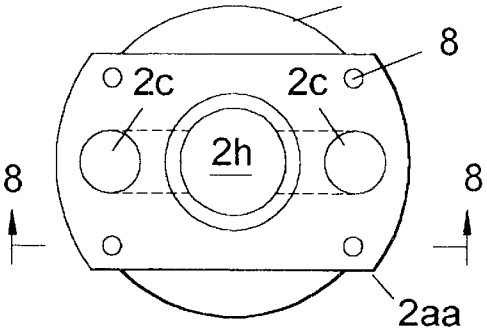
FIG. 7 is a top view of part of the component shown in FIG. 3 taken along line 7—7, with a component omitted.

In FIG. 7, the cover plate is omitted to show the openings of channels 2*c*. There are four screws 8 and four springs 10. All other features and functions remain as previously described herein.

Figure 8:
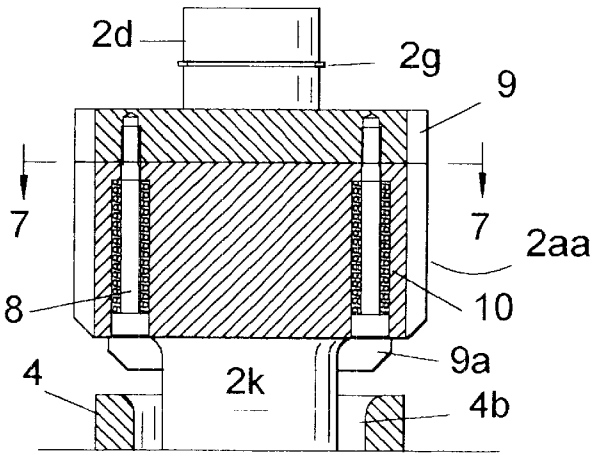
FIG. 8 is a side view similar to FIG. 5, taken along line 8—8, showing an alternate version of part of the apparatus.

FIG. 8 is similar to FIG. 5 with springs replacing the frangible screws to hold the cover plate on arbor head 2*aa*. Otherwise, the action is the same in terms of the downward movement of the arbor causing flow through channels 2*c*.

Figure 9:
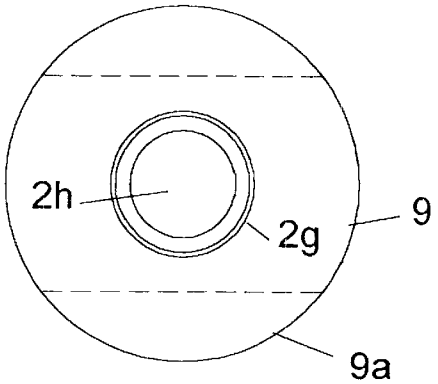
FIG. 9 is a top view similar to FIG. 7 with the omitted component in place.

FIG. 9 is a top view of the cover plate 9. This differs from FIG. 3 only with by absence of cap screw recesses.

Figure 10:
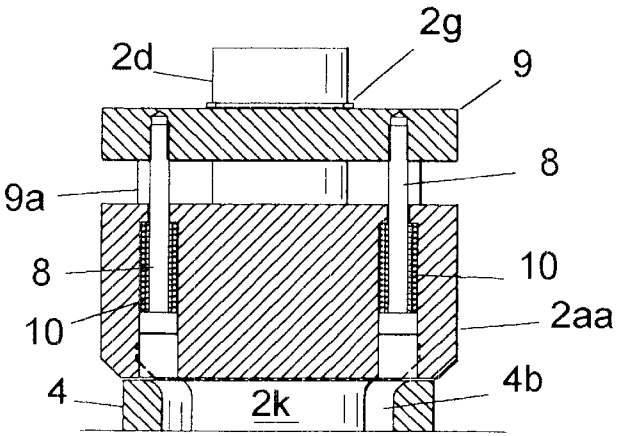
FIG. 10 is a side view, identical to FIG. 8, shown after actuation.

FIG. 10 is identical to FIG. 8 except that the cover plate has been actuated to the open state to by-pass fluid through the motor rotor bore.

Figure 12:
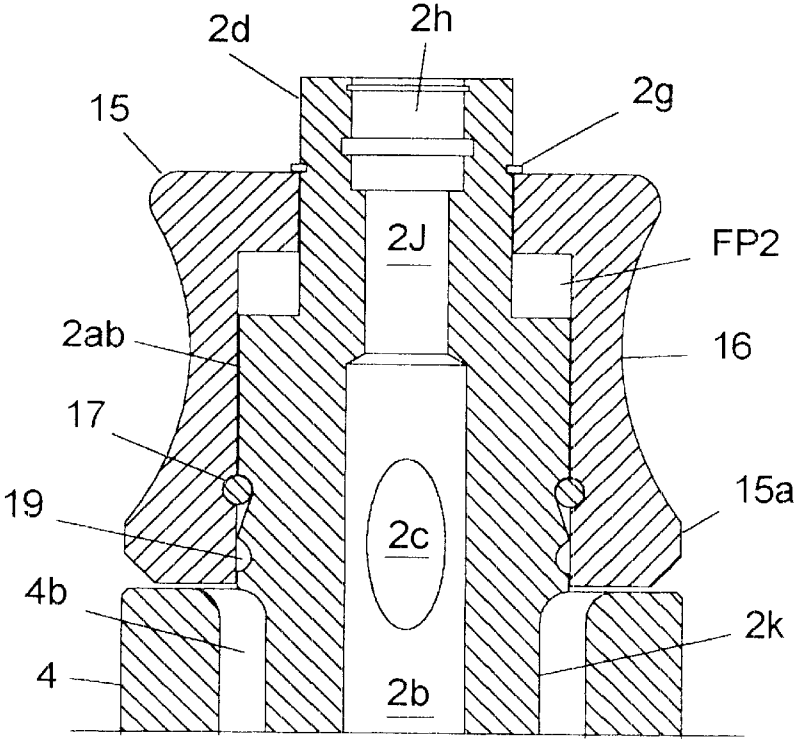
FIG. 12 is identical to FIG. 11, after actuation.
Figure 11:
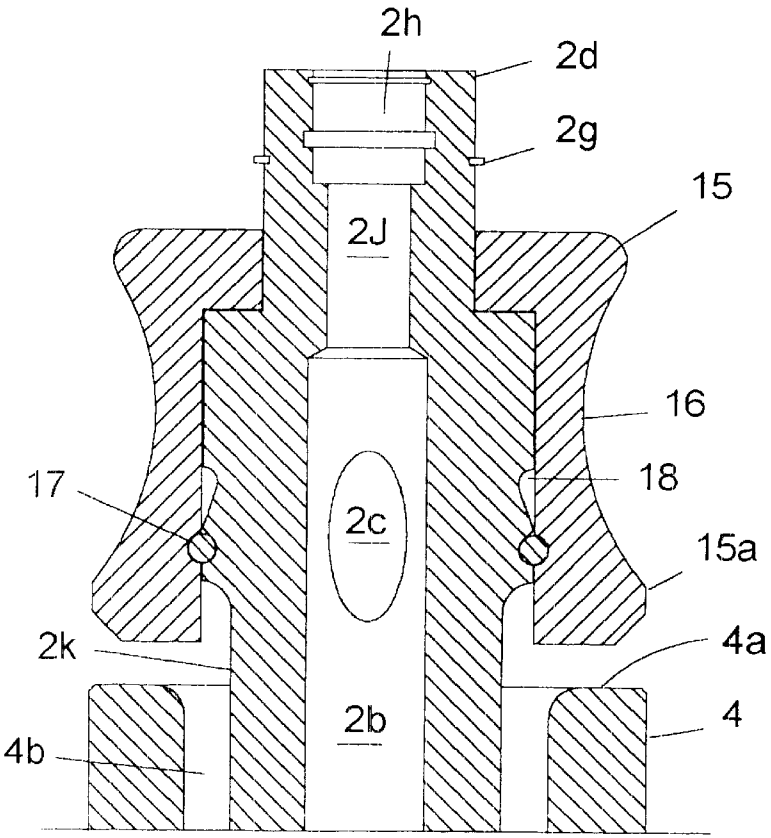
FIG. 11 is a side view, similar to FIG. 4, somewhat enlarged, but of an alternate construction.

FIGS. 11 and 12 are enlarged views of the portion of the apparatus shown in FIGS. 4 and 6 with a detent arrangement, rather than breakable screws or springs to control the positions retained by the actuator arms. The cover plate 15 and the attached actuator arms 15*a* utilize the resilient nature of the U shape to provide bias to hold the roller 17 in either groove 18 or 19. Arcuate cut-outs 16 provide means to determine the effective spring rate, and location of distortion, of the U shape of the cover plate and actuator arm combination. When the valve is in the closed state, the rollers are in grooves 19. When arbor 2 moves downward, and the arms engage surface 4*a* as previously described herein, the actuator arms spring outward to resist but permit the rollers to move into grooves 18. Once the rollers are in grooves 18 that position is retained by the inward force of the actuator arms.

From the foregoing, it will be seen that this invention is one well adapted to attain all of the ends and objects hereinabove set forth, together with other advantages which are obvious and which are inherent to the tool.

It will be understood that certain features and sub-combinations are of utility and may be employed without reference to other features and sub-combinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

I claim:

1. A motor failure indication by-pass valve apparatus for use as a serial element of a drill string comprising a drilling motor with a power producing portion and a tubular rotor capable of conducting drilling fluid along a flow route that by-passes the power producing portion of the motor, the apparatus comprising:

a) a generally tubular housing with means for fluid tight attachment to the body of the downwardly extending down hole motor body, and means for fluid tight attachment to an upwardly continuing drill string, and a generally central opening;

b) an arbor, in the generally central opening, with means for attachment to the motor rotor with a by-pass fluid channel to conduct fluid from inside the housing to the bore of the tubular rotor;

c) a normally closed valve carried by said arbor, situated to control movement of fluid along said by-pass fluid channel; and d) a valve actuator means in said housing arranged to respond to axial movement of the rotor, relative to the housing, to open the normally closed valve.

2. The apparatus of claim 1 wherein said valve actuator means is a surface on the housing arranged to engage an element of the valve actuator means.

3. The apparatus of claim 1 wherein said valve is retained in a closed condition by limited strength frangible elements that are failed to allow the valve to open.

4. The apparatus of claim 1 wherein said valve is retained in the closed condition by biasing springs.

5. The apparatus of claim 1 wherein said valve is retained in a closed condition by spring loaded detents that are movable to an open condition with a preselected amount of force.

6. The apparatus of claim 5 wherein said detents retain the valve in the open condition after the valve is moved from the closed condition.

7. A down hole motor apparatus, having a failure indication by-pass valve apparatus, for use as serial elements of a drill string, the apparatus comprising:

a) a down hole motor with a body and a tubular rotor, in a power producing portion of the motor, capable of conducting drilling fluid along a flow route that by-passes the power producing portion of the motor;

b) a generally tubular housing with means for fluid tight attachment to the down hole motor body, and means for fluid tight attachment to an upwardly continuing drill string, and a generally central opening;

c) an arbor, in the generally central opening, with means for attachment to the motor rotor with a by-pass fluid channel to conduct fluid from inside the housing to the bore of the tubular rotor;

d) a normally closed valve carried by said arbor, situated to control movement of fluid along said by-pass fluid channel; and e) a valve actuator means in said housing arranged to respond to axial movement of the rotor, relative to the housing, to open the normally closed valve.

8. The apparatus of claim 7 wherein said valve actuator means is a surface on the housing arranged to engage an element of the valve actuator means.

9. The apparatus of claim 7 wherein said valve is retained in the closed condition by limited strength frangible elements that are failed to allow the valve to open.

10. The apparatus of claim 7 wherein said valve is retained in a closed condition by biasing springs.

11. The apparatus of claim 7 wherein said valve is retained in a closed condition by spring loaded detents that are movable to an open condition with a preselected amount of force.

12. The apparatus of claim 11 wherein said detents retain the valve in the open condition after the valve is moved from the closed condition.

13. A motor failure indication by-pass valve apparatus for use as a serial element of a drill string comprising a drilling motor having a power producing portion with a tubular rotor capable of conducting drilling fluid along a flow route that by-passes the power producing portion of the motor, the apparatus comprising:

a) a generally tubular housing with means for fluid tight attachment to the down hole motor, and means for fluid tight attachment to an upwardly continuing drill string, and a generally central drilling fluid conducting opening;

b) an arbor, situated in the generally central drilling fluid conducting opening, with means for attachment to the motor rotor and having a by-pass fluid channel to conduct fluid from the generally central drilling fluid conducting opening to the bore of the tubular rotor;

c) a normally closed valve carried by said arbor, situated to control movement of fluid along said by-pass fluid channel; and d) a valve actuator means in said housing arranged to respond to axial movement of the rotor, relative to the housing, to open the normally closed valve.

14. The apparatus of claim 13 wherein said valve actuator means is a surface on the housing arranged to engage an element of the valve actuator means.

15. The apparatus of claim 13 wherein said valve is retained in a closed condition by limited strength frangible elements that are failed to allow the valve to open.

16. The apparatus of claim 13 wherein said valve is retained in a closed condition by biasing springs.

17. The apparatus of claim 13 wherein said valve is retained in a closed condition by spring loaded detents that are movable to an open condition with a preselected amount of force.

18. The apparatus of claim 16 wherein said detents retain the valve in an open condition after the valve is moved from the closed condition.

* * * * *